US011421441B2

(12) United States Patent
Howell

(10) Patent No.: US 11,421,441 B2
(45) Date of Patent: Aug. 23, 2022

(54) WATER-BALLASTED PROTECTION BARRIER ARRAY AND FENCING AND GATE ASSEMBLIES FOR USE WITH THE SAME

(71) Applicant: Shane D. Howell, Dallas, TX (US)

(72) Inventor: Shane D. Howell, Dallas, TX (US)

(73) Assignee: Shane D. Howell, Dallas, TX (US)

( * ) Notice: Subject to any disclaimer, the term of this patent is extended or adjusted under 35 U.S.C. 154(b) by 501 days.

(21) Appl. No.: 15/868,698

(22) Filed: Jan. 11, 2018

(65) Prior Publication Data

US 2018/0223561 A1 Aug. 9, 2018

Related U.S. Application Data

(60) Provisional application No. 62/455,746, filed on Feb. 7, 2017.

(51) Int. Cl.
*E04H 17/16* (2006.01)
*E06B 11/02* (2006.01)
(Continued)

(52) U.S. Cl.
CPC ..... *E04H 17/163* (2013.01); *E01F 13/022* (2013.01); *E01F 15/088* (2013.01);
(Continued)

(58) Field of Classification Search
CPC ..... E04H 17/163; E04H 17/165; E04H 2017/1447; E04H 2017/1452;
(Continued)

(56) References Cited

U.S. PATENT DOCUMENTS 2,308,965 A 1/1943 Riesing
3,469,822 A * 9/1969 Francis ..... E04H 17/18 256/25
(Continued)

FOREIGN PATENT DOCUMENTS

CA 2307146 A1 * 11/2001 ..... E04H 17/18
EP 0347388 A1 * 12/1989 ..... E01F 13/02
(Continued)

OTHER PUBLICATIONS

TrafFix Devices, Inc., Water-Wall Fence, Oct. 8, 2014 <https://web.archive.org/web/20141008041053/http://www.traffixdevices.com:80/products/barriers/water-wall-fence/> (Year: 2014).*

*Primary Examiner* — Josh Skroupa
(74) *Attorney, Agent, or Firm* — Scott Griggs; Griggs Bergen LLP

(57) ABSTRACT

A water-ballasted protection barrier array and fencing and gate assemblies are disclosed. In one embodiment of the water-ballasted protection barrier array, first fence assemblies are placed in a superjacent relationship with barrier segments to form stacked first fence assembly-barrier segment combinations. The water-ballasted protection barrier array may be constructed by placing second fence assemblies in lateral interposed relationships with two stacked first fence assembly-barrier segment combinations. Alternatively, gate assemblies may be placed in lateral interposed relationships with two stacked first fence assembly-barrier segment combinations to buildout the water-ballasted protection barrier array. A system of connecting lugs and connectors having a common vertical axial alignment such that a connecting rod is inserted therethrough to securably join the components of the water-ballasted protection barrier array.

14 Claims, 5 Drawing Sheets

(51) Int. Cl.
*E04H 17/20* (2006.01)
*E01F 13/02* (2006.01)
*E01F 15/08* (2006.01)
*E04H 17/14* (2006.01)

(52) U.S. Cl.
CPC ..... *E04H 17/20* (2013.01); *E06B 11/021* (2013.01); *E04H 17/1447* (2021.01)

(58) Field of Classification Search
CPC . E04H 2017/1456; E04H 17/22; E04H 17/20; E04H 17/013; E01F 15/088; E01F 13/02; E01F 13/024; E01F 13/028; E01F 13/022; E06B 11/021; Y10T 403/11
USPC ..... 256/65.14, 73; 403/2
See application file for complete search history.

(56) References Cited

U.S. PATENT DOCUMENTS 4,047,332 A * 9/1977 Benoit ..... E05D 7/06 49/236
4,072,295 A * 2/1978 Roberts ..... A63B 71/022 256/26
4,257,527 A 3/1981 Snyder et al.
4,500,225 A 2/1985 Quillner
4,610,432 A * 9/1986 Lewis ..... A63K 1/00 256/1
4,685,656 A * 8/1987 Lee ..... E01F 15/025 256/13.1
4,869,617 A 9/1989 Chiodo
5,052,850 A 10/1991 Bishop
5,100,108 A * 3/1992 Schultz ..... E04H 3/12 256/23
5,104,255 A 4/1992 Bodensohn
5,402,988 A * 4/1995 Eisele ..... E01F 13/022 160/351
5,498,101 A 3/1996 Braverman
5,605,413 A 2/1997 Brown
5,664,769 A * 9/1997 Sadinsky ..... E04H 4/06 256/25
D400,264 S 10/1998 Striefel et al.
5,882,140 A 3/1999 Yodock et al.
5,988,934 A 11/1999 Wasserstrom
6,059,491 A 5/2000 Striefel et al.
D431,657 S 10/2000 Wasserstrom
6,203,242 B1 3/2001 Englund
6,413,009 B1 7/2002 Duckett
D462,126 S 8/2002 Englund
6,666,616 B2 12/2003 Yodock et al.
6,669,402 B1 12/2003 Davis et al.
6,863,468 B2 3/2005 Davis et al.
6,893,057 B2 5/2005 Evans
7,641,179 B2 * 1/2010 Sherrard ..... E04H 17/066 256/32
7,686,283 B2 * 3/2010 Marchio ..... E06B 11/021 256/73
7,874,545 B2 * 1/2011 Fumagalli ..... E01F 13/022 256/25
7,931,422 B2 4/2011 Kulp et al.
8,235,625 B1 8/2012 Kulp et al.
8,491,217 B2 * 7/2013 Kulp ..... B29C 39/08 404/6
9,458,645 B1 * 10/2016 King ..... E04H 17/16
D777,460 S * 1/2017 Martell ..... D6/332
9,650,749 B1 * 5/2017 Maus ..... E01F 15/08
2002/0067951 A1 6/2002 Paterson
2004/0057792 A1 3/2004 Yodock et al.
2004/0096273 A1 5/2004 Yodock et al.
2007/0252125 A1 * 11/2007 Thompson ..... E04H 17/163 256/24
2011/0274486 A1 * 11/2011 White ..... E01F 13/12 404/6
2016/0076209 A1 3/2016 Maus et al.
2017/0096836 A1 * 4/2017 Ritter ..... E01F 9/692
2018/0327995 A1 * 11/2018 Earhart ..... E04H 12/2269
2019/0234103 A1 * 8/2019 Fakhari ..... E01F 9/00

FOREIGN PATENT DOCUMENTS

FR 2749329 A1 * 12/1997 ..... E01F 15/0476
GB 470464 A * 8/1937 ..... E01F 13/00

* cited by examiner

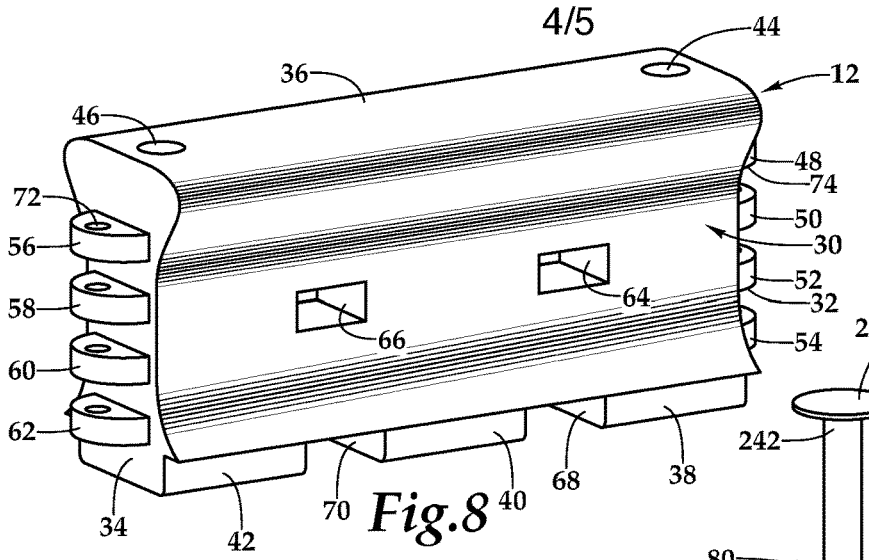
Fig.8
Fig.10
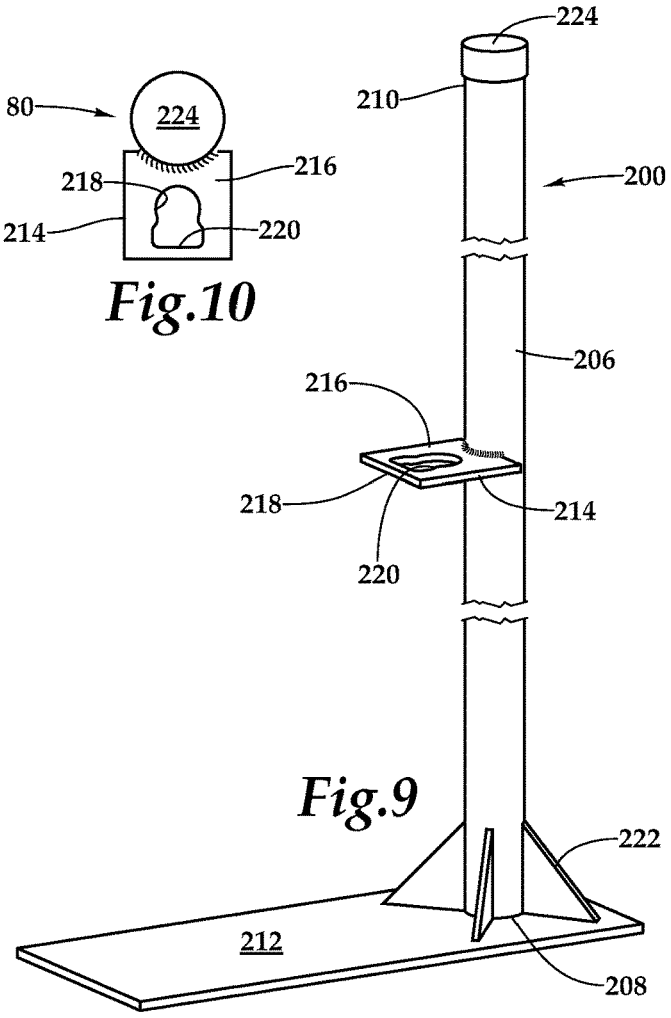
Fig.9
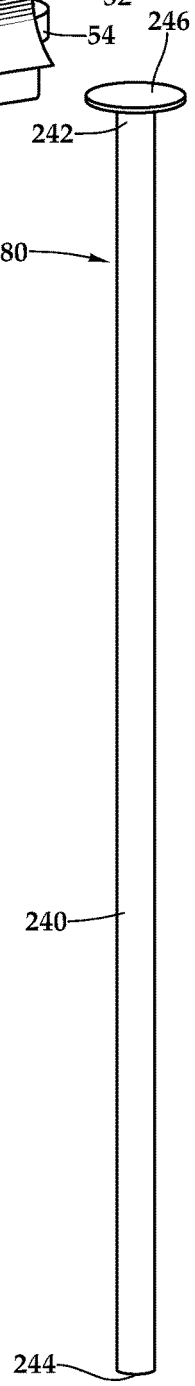
Fig.11
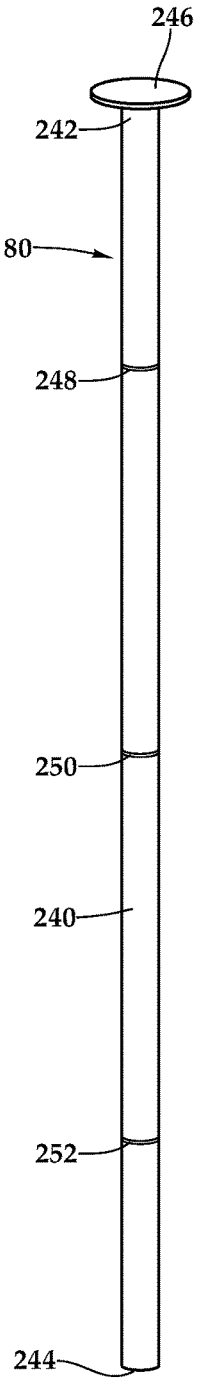
Fig.12

WATER-BALLASTED PROTECTION BARRIER ARRAY AND FENCING AND GATE ASSEMBLIES FOR USE WITH THE SAME

PRIORITY STATEMENT & CROSS-REFERENCE TO RELATED APPLICATION

This application claims priority from U.S. Patent Application No. 62/455,746, entitled "Water-Ballasted Protection Barrier Array and Fencing and Gate Assemblies for Use with the Same" and filed on Feb. 7, 2017, in the name of Shane D. Howell; which is hereby incorporated by reference for all purposes.

TECHNICAL FIELD OF THE INVENTION

This invention relates, in general, to protection barriers and, in particular, to fencing and gate applications for water-ballasted protection barrier arrays of the type utilized to define work zone separation to furnish safety to pedestrians, vehicles, and a workforce in construction zones and similar environments.

BACKGROUND OF THE INVENTION

Water-ballasted protection barriers are composed of molded, lightweight plastic and are hollow, having a fill port for receiving water to ballast the particular water-ballasted protection barrier in place. The water-ballasted protection barriers are fabricated to be sectional and modular for ease of transport to a desired location. At the desired location, the water-ballasted protection barriers may be attached together lengthwise to create a barrier array of any desired length. Once multiple water-ballasted protection barriers are efficiently attached together, the formed water-ballasted protection barrier array provides work zone separation and therefore safety to pedestrians, vehicles, and the workforce in construction zones and similar environments. A continual need exists for improved water-ballasted protection barrier arrays that improve efficiency in assembling and provide for increased safety.

SUMMARY OF THE INVENTION

It would be advantageous to achieve water-ballasted protection barrier arrays that would improve upon existing limitations in functionality. It would also be desirable to enable a mechanical-based solution that would provide enhanced efficiency in assembling and provide for increased safety in construction zones and similar environments. To better address one or more of these concerns, a water-ballasted protection barrier array and fencing and gate assemblies are disclosed. In one embodiment of the water-ballasted protection barrier array, first fence assemblies are placed in a superjacent relationship with barrier segments to form stacked first fence assembly-barrier segment combinations. The water-ballasted protection barrier array may be constructed by placing second fence assemblies in lateral interposed relationships with two stacked first fence assembly-barrier segment combinations. Alternatively, gate assemblies may be placed in lateral interposed relationships with two stacked first fence assembly-barrier segment combinations to buildout the water-ballasted protection barrier array. A system of connecting lugs and connectors having a common vertical axial alignment such that a connecting rod is inserted therethrough to securably join the components of the water-ballasted protection barrier array. These and other aspects of the invention will be apparent from and elucidated with reference to the embodiments described hereinafter.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which:

FIG. 8 is a front perspective top view of one embodiment of a barrier segment, which forms a portion of the water-ballasted protection barrier array depicted in FIG. 1 in further detail;

FIG. 9 is a front perspective top view of one embodiment of a portion of a gate assembly, which forms a portion of the water-ballasted protection barrier array depicted in FIG. 1;

FIG. 10 is a top plan view of the gate assembly depicted in FIG. 9;

FIG. 11 is a front elevation view of one embodiment of a connecting rod, which forms a portion of the water-ballasted protection barrier array depicted in FIG. 1;

FIG. 12 is a front elevation view of another embodiment of a connecting rod;

DETAILED DESCRIPTION OF THE INVENTION

Figure 1:
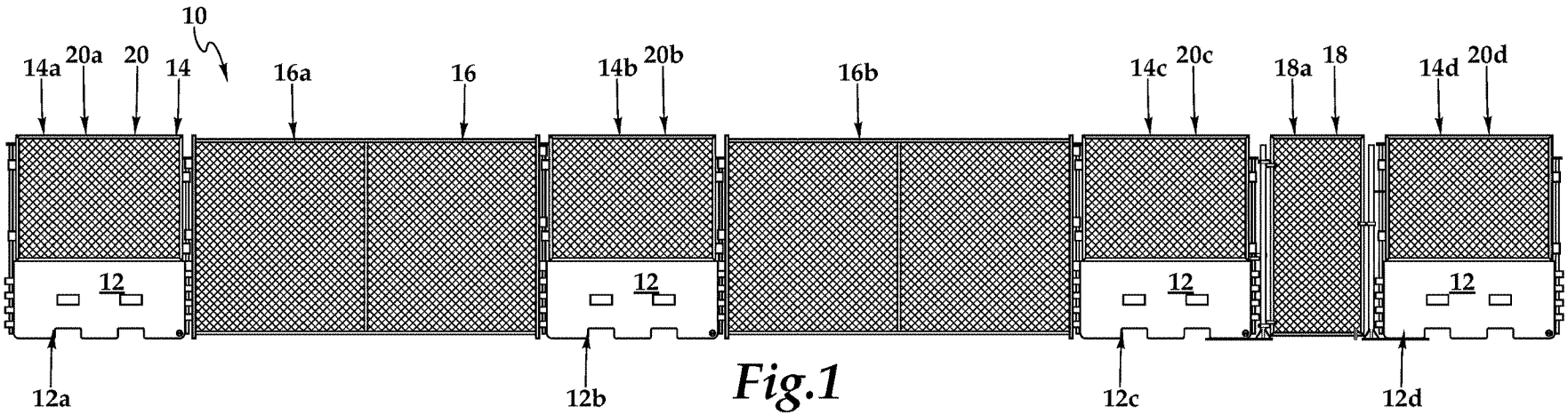
FIG. 1 is a front elevation view illustrating one embodiment of a water-ballasted protection barrier array with fencing and gate assemblies for use of the same according to the teachings presented herein.
Figure 3:
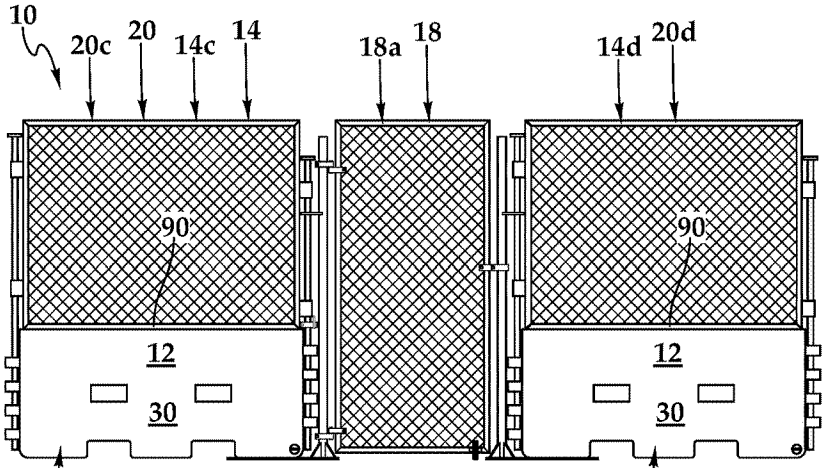
FIG. 3 is a front elevation view illustrating the water-ballasted protection barrier array and the gate assembly depicted in FIG. 1 in further detail.
Figure 2:
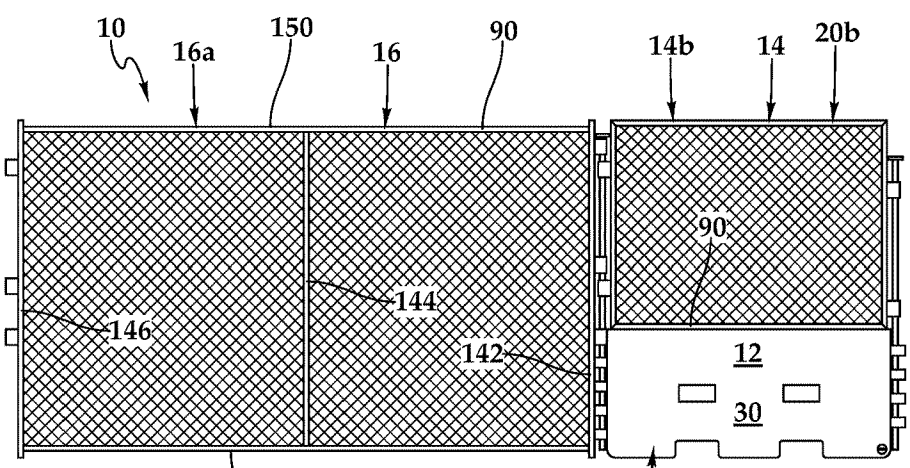
FIG. 2 is a front elevation view illustrating the water-ballasted protection barrier array and fencing assembly depicted in FIG. 1 in further detail.
Figure 5:
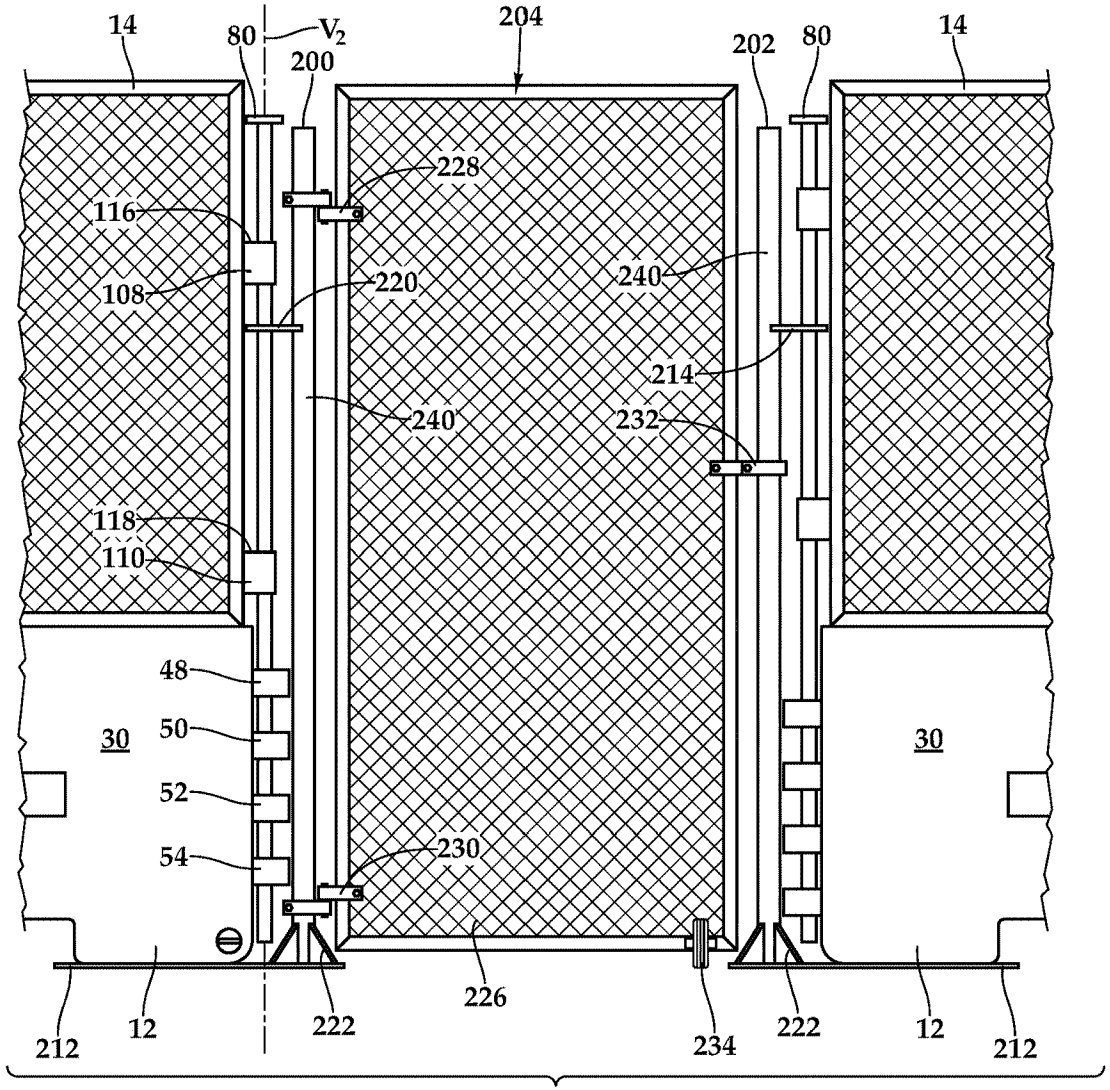
FIG. 5 is a front elevation view illustrating the water-ballasted protection barrier array with the gate assembly depicted in FIG. 1 in further detail.
Figure 4:
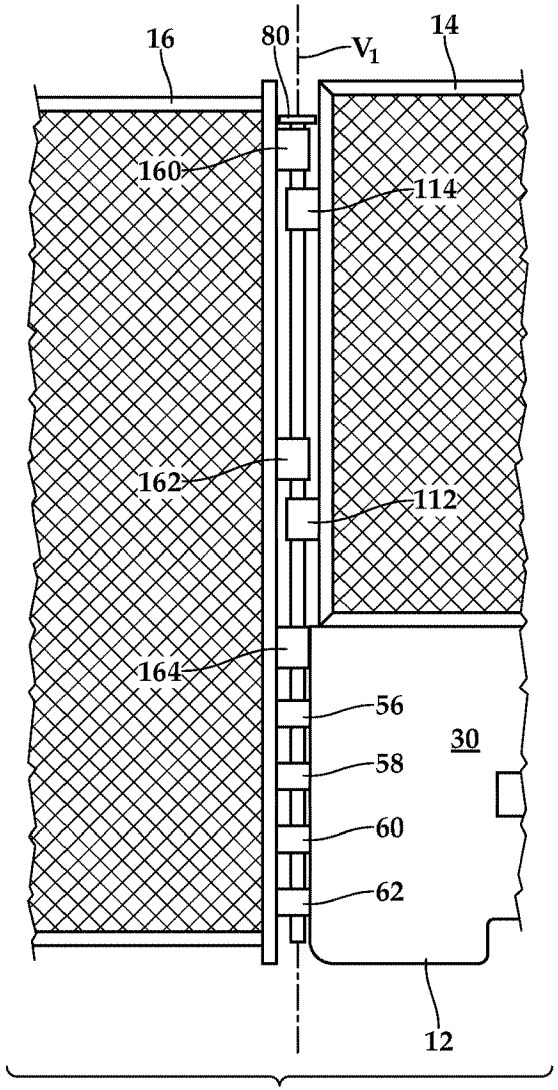
FIG. 4 is a front elevation view illustrating the water-ballasted protection barrier array with the fencing assembly depicted in FIG. 1 in further detail.
Figure 7:
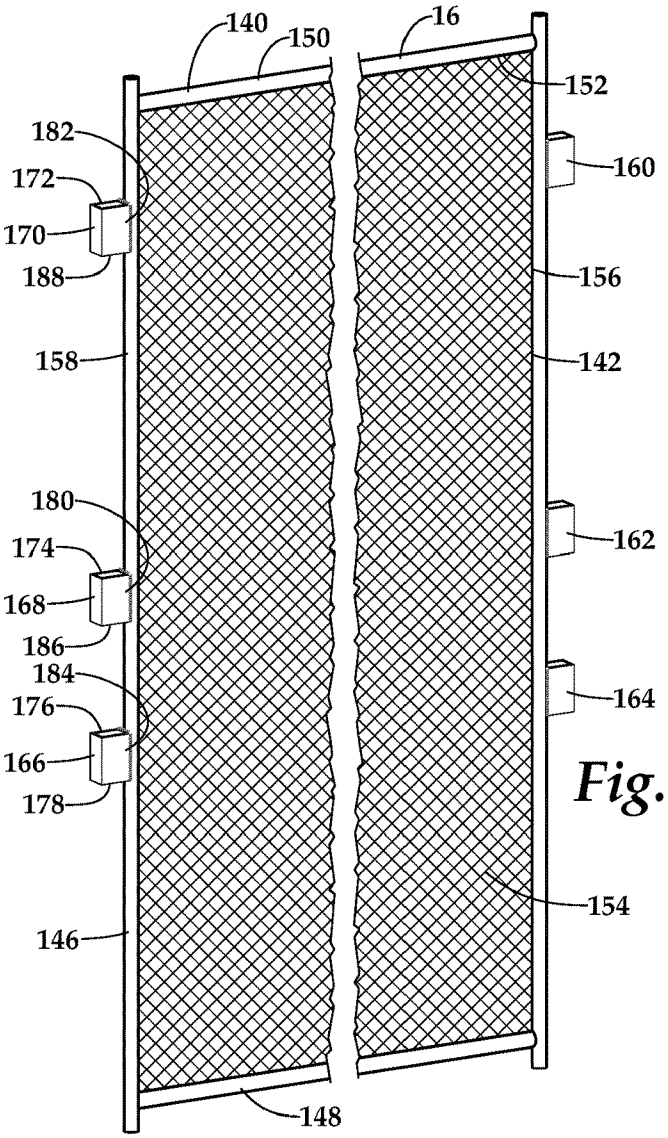
FIG. 7 is a front perspective top view of one embodiment of a portion of a lateral fence assembly, which forms a portion of the water-ballasted protection barrier array depicted in FIG. 1 in further detail.
Figure 6:
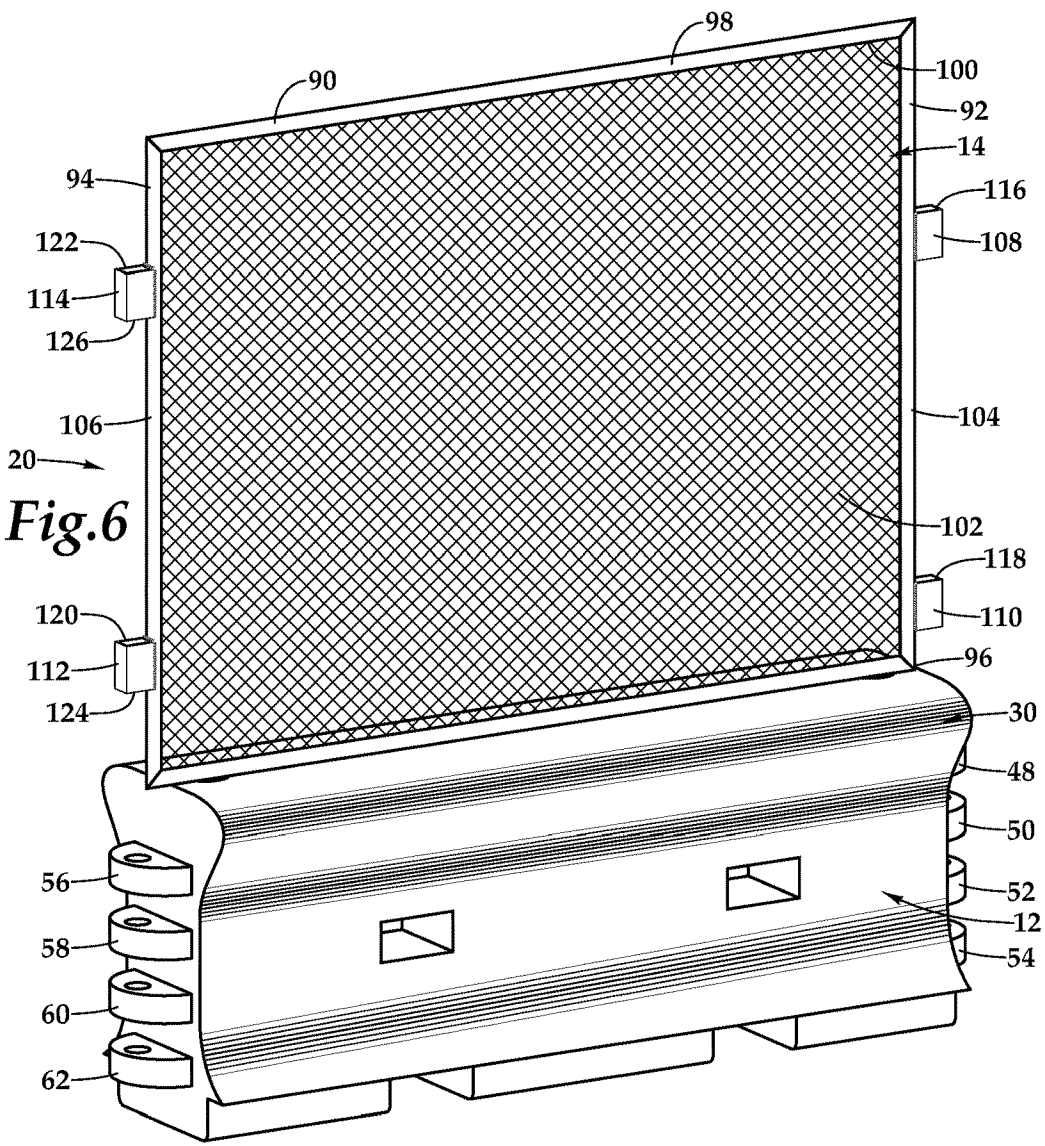
FIG. 6 is a front top perspective view illustrating one embodiment of a portion of an upper fence assembly, which forms a portion of the water-ballasted protection barrier array depicted in FIG. 1.

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the present invention.

Referring initially to FIG. 1 through FIG. 11, therein is depicted one embodiment of a water-ballasted protection barrier array 10, which is illustrated according to the teachings presented herein. In one implementation, the water-ballasted protection barrier array 10 includes barrier segments 12, upper fence assemblies 14, lateral fence assemblies 16, and gate assemblies 18. As discussed in further detail hereinbelow, the combination of barrier segment 12 and the upper fence assembly 14 is a stacked upper fence assembly-barrier segment combination 20. More particularly, in the illustrated embodiment, the barrier segments 12 include barrier segments 12A, 12B, 12C, and 12D, which may be individually referenced by the number 12 also. The upper fence assemblies include upper fence assemblies 14A, 14B, 14C, and 14D, which may be individually referenced by the number 14 also. The lateral fence assemblies 16 include lateral fence assemblies 16A and 16B and the gate assemblies 18 include gate assembly 18A. As previously suggested, the lateral fence assemblies may be individually referenced by the number 16 and the gate assembly may be individually referenced by the number 18. Stacked upper fence assembly-barrier segment combinations 20 include stacked upper fence assembly-barrier segments 20A, 20B, 20C, and 20D, which may be individually referenced by the number 20.

Each of the barrier segments 12 may be hollow and adapted to be filled with a fluent material for ballast. As shown, in one embodiment, a molded plastic container 30 includes outer walls defining an interior volume. The molded plastic container 30 includes ends 32, 34, an upper surface 36, and feet 38, 40, 42 extending therefrom. Upper post receptacles 44, 46 are located on the upper surface 36. Connecting lugs 48, 50, 52, 54 are disposed on the end 32 and connecting lugs 56, 58, 60, 62 are disposed on the end 34. Forklift through holes 64, 66 are located in the molded plastic container 30. Pallet jack through holes 68, 70 are located respectively between the feet 38, 40 and the feet 40, 42. The barrier segment 12 may further include a metallic bushing insert 72 molded into one of the connecting lugs, such as the connecting lug 56, to form a channel though which a drop pin 80 may be extended to securably join the barrier segment 12 with one of another barrier segment 12, one of the upper fence assemblies 14, one of the lateral fence assemblies 16, or one of the gate assemblies 18, for example. Similarly, a metallic bushing insert 74 may be located in the connecting lug 48 to provide a channel for the drop pin 80.

In one implementation, the barrier segment 12 may have the molded plastic container 30 manufactured from durable polyethylene plastic to minimize cracking and breaking. Such a barrier segment 12 may weigh about 80 lbs (36.3 kg) empty and about 1,110 lbs (503.5 kg) full of water. The length may be about 6 ft (182.9 cm) with a width of about 18 in (45.8 cm) and a height of about 32 in (81.2 cm). The color will typically be orange/red or white.

Each of the upper fence assemblies 14 includes a pipe frame 90 sized to fit in a superjacent relationship with one of the barrier segments 12 to form the previously mentioned stacked upper fence assembly-barrier segment combination 20. In one embodiment, the pipe frame 90 includes interconnected vertical pipe frame members 92, 94 and horizontal pipe frame members 96, 98. As will be appreciated, following installation, the vertical pipe frame members 92, are respectively positioned within the upper post receptacles 44, 46 of the barrier segment 12. The pipe frame 90 defines an interior space 100 spanned by a chain link mesh 102. Further, the pipe frame 90 includes ends 104, 106 respectively positioned at the vertical pipe frame members 92, 94 with connectors 108, 110 disposed at the end 104 and connectors 112, 114 disposed at the end 106. Each of the connectors, such as connectors 108, 110, has an opening therethrough, such as openings 116, 118. In one embodiment, as shown, the connectors 112, 114, include vertically spaced connector boxes 120, 122, each having a channel 124, 126 therethrough for accepting the drop pin 80.

In one implementation, the upper fence assembly 14 includes the vertical pipe frame members 92, 94 each having a height of about 52 in (132.1 cm) and the horizontal pipe frame members 96, 98 each having a length of about 69 in (175.3 cm). The vertical pipe frame members 92, 94 and the horizontal pipe frame members 96, 98 may be 1⅜ in (3.492 cm) galvanized steel. The chain link mesh 102 may be about 11 gauge galvanized wire with an approximate 2.7 in (6.858 cm) mesh opening with the chain link mesh 102 laced through the bottom mesh openings. Cold zinc may be applied to the weldings. The connectors 108, 110 at the end 104 may be respectively located at about 5 in (12.7 cm) and about 34.75 in (88.265 cm) above the ground or above the barrier segment following installation. The connectors 112, 114 at the end 106 may be respectively located at about 8.25 in (21 cm), and about 37.75 in (95.885 cm) above the ground or above the barrier segment following installation. The connector boxes 124, 126 may be about 4 in (10.16 cm) by about 1.5 in (3.81 cm) in size.

Each of the lateral fence assemblies 16 includes a pipe frame 140 sized to fit in a lateral interposed relationship with two spaced stacked first fence assembly-barrier segment combinations 20. The pipe frame 140 includes interconnected vertical pipe frame members 142, 144, 146 and horizontal pipe frame members 148, 150. The pipe frame 140 defines an interior space 152 spanned by a chain link mesh 154. The pipe frame 140 has respective ends 156, 158 at the vertical pipe frame member 142 and the vertical pipe frame member 146. Connectors 160, 162, 164 are located at the end 156 and connectors 166, 168, 170 are located at the end 158. The connectors each have an opening therethrough, such as the connectors 166, 168, 170 having respective openings 176, 174, 172. In one embodiment, the connectors include vertically spaced connector boxes 178, 180, 182 each having a channel 184, 186, 188 therethrough for accepting the connecting rod.

In one implementation, the lateral fence assembly includes the vertical pipe frame members 142, 144, 146 each having a height of about 84 in (213.4 cm) and the horizontal pipe frame members 148, 150 each having a length of about 117 in (198.1 cm). The vertical pipe frame members 142, 144, 146 and the horizontal pipe frame members 148, 150 may be 1⅜ in (2.54 cm) galvanized steel. The chain link mesh 154 may be about 11 gauge galvanized wire with an approximate 2.7 in (6.86 cm) mesh opening with the chain link mesh 154 laced through the bottom mesh openings. Cold zinc may be applied to the weldings. The connectors 160, 162, 164 at the end 156 may be respectively located at about 30 in (76.2 cm), about 48 in (121.92 cm), and about 77.5 in (196.85 cm) above the ground. The connectors 166, 168, 170 at the end 158 may be respectively located at about 30 in (76.2 cm), about 42.75 in (108.59 cm) above, and about 72.5 in (184.15 cm) above the ground. The connector boxes 178, 180, 182 may be about 4 in (10.16 cm) by about 1.5 in (3.81 cm) in size.

The gate assembly 18 includes a pair of horizontally spaced and opposing gate posts 200, 202 configured to accept a door assembly 204 therebetween. The pair of gate posts 200, 202 are sized to fit in a lateral interposed relationship with two stacked upper fence assembly-barrier segment combinations 20. Each of the gate posts 200, 202, which gate post 200 as an illustrative example, includes an upright body 206 having ends 208, 210. A plate 212 is secured to the end 208 and extends therefrom. The plate 212, which may be substantially rectangular in shape, is sized to fit beneath one of the barrier segments 12 and, in particular, under one of the feet 38, 42 of the barrier segment for support and stabilization. A connector extends 214 from the upright body 206 and includes an opening 216 therethrough. In one embodiment, the connector 214 includes a tab 218 having a keyhole 220 therethrough for accepting the drop pin. A gusset 222 is located at the 208 to aid in stabilization. A water cap 224 may be placed at the end 210 to prevent water from entering the upright body 206. The door assembly may include an openable gate 226 hingedly connected to the gate post 202 by fastening hinges 228, 230 and selectably securable to the gate post 200 by latch 232. A wheel 234 may provide additional support to the gate 224.

In one implementation, the gate post 200 may be about 84 in (213.36 cm) in height and constructed of approximately 3 in (7.62 cm) galvanized steel. The plate 212 may be about a ¼ in (0.64 cm) plate that is about 36 in (91.44 cm) by about 1 in (2.54 cm). The tab 218 may be located 29 in (73.66 cm) above the ground and may be ¼ in (0.64 cm) in size. The gusset 222 may be about 5 in (12.7 cm).

Figure 14:
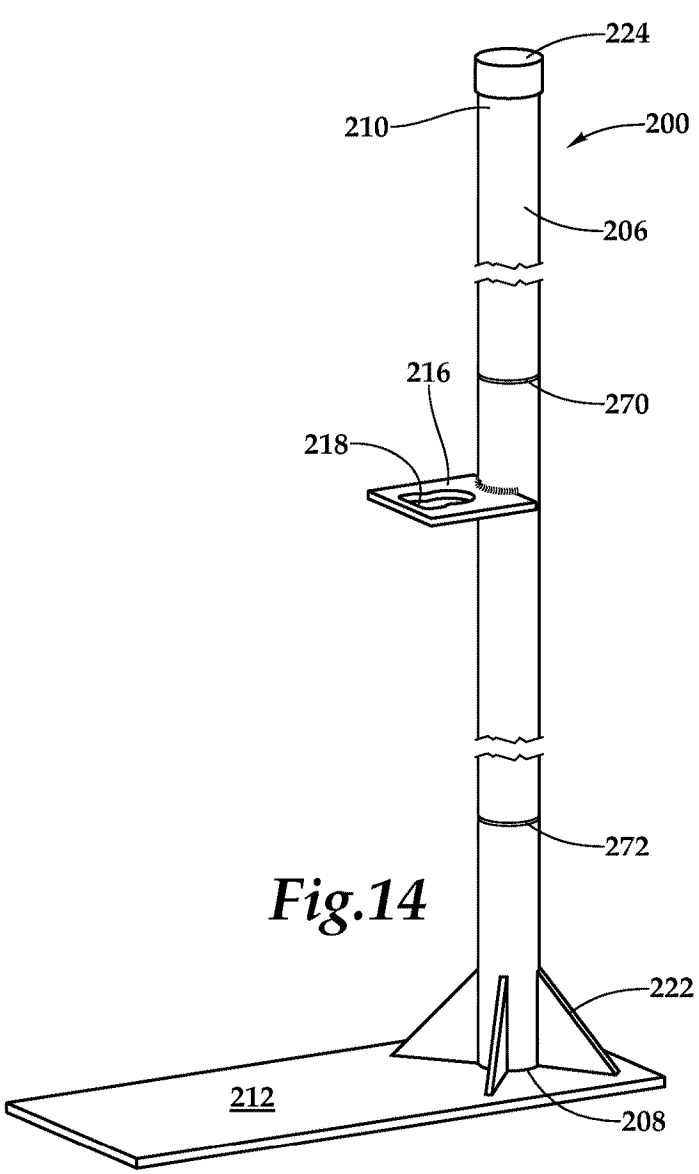
FIG. 14 is a front elevation view of another embodiment of a gate assembly.
Figure 13:
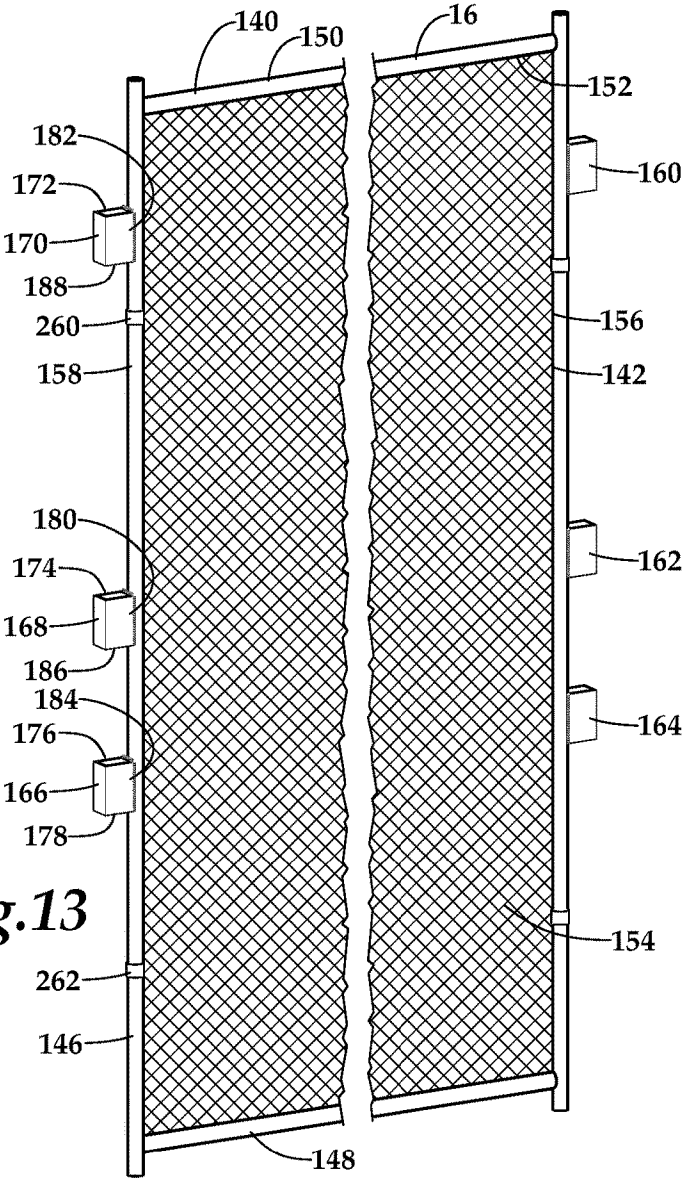
FIG. 13 is a front elevation view of another embodiment of a lateral fence assembly.

In one embodiment, the drop pin 80 may include a vertical rod 240 having ends 242, 244. A head 246 is located at the end 242. Referring now to FIG. 12, in another embodiment, the vertical rod 240 may include the ends 242, 244 with the head 246 being located at the end 242. The vertical rod 240 may include at least one frangible break-point therein and, as illustrated, frangible break-points 248, 250, 252 are included. Such frangible break-points may be included to assist in meeting current federal highway safety standards, specifically the Federal Highway Administration Standards of Report NCHRP 350, which requires barrier systems to pass vehicle impact tests. Such frangible break-points may be incorporated into the upper fence assemblies 14, lateral fence assemblies 16, or the gate assemblies 18 discussed above. The frangible break-points provide controlled relief of excess force. By way of example and not by way of limitation, FIG. 13 depicts another embodiment of the pipe frame 90 of the lateral fence assembly incorporating frangible break-points 260, 262 and similarly, FIG. 14 depicts another embodiment of the gate post 200 of the gate assembly 18 incorporating frangible break-points 270, 272.

Referring again to FIG. 1 through FIG. 11, in general, a system of connecting lugs and connectors have a common vertical axial alignment such that a connecting rod is inserted therethrough to securably join the components of the water-ballasted protection barrier array. More specifically, with reference to FIG. 4, the connecting lugs 56, 58, 60, 62, the connectors 112, 114, and the connectors 160, 162, 164 have a common vertical axial alignment, alignment $V_1$, as well as distinct non-mutually-interfering vertical positioning, such that the drop pin 80 is inserted therethrough to securably join the fence assembly-barrier segment combination and the lateral fence assembly 16. Similarly, with reference to FIG. 5, the connecting lugs 48, 50, 52, 54, the connectors 108 and 110 have a common vertical axial alignment, alignment $V_2$, as well as distinct non-mutually-interfering vertical positioning, such that the drop pin 80 is inserted therethrough to securably join the upper fence assembly-barrier segment combination 20 and the gate assembly 18.

As will be appreciated, by utilizing the system of connecting lugs and connectors presented herein, the water-ballasted protection barrier array 10 may be constructed by placing lateral fence assemblies in lateral interposed relationships with two stacked upper fence assembly-barrier segment combinations and selectively installing gate assemblies in lateral interposed relationships with two stacked upper fence assembly-barrier segment combinations to buildout the water-ballasted protection barrier array. It will be appreciated that such a construction optimizes the number of barrier segments required while providing a safe environment that does not require the use of sandbags to secure fencing in position.

The order of execution or performance of the methods and techniques illustrated and described herein is not essential, unless otherwise specified. That is, elements of the methods and techniques may be performed in any order, unless otherwise specified, and that the methods may include more or less elements than those disclosed herein. For example, it is contemplated that executing or performing a particular element before, contemporaneously with, or after another element are all possible sequences of execution.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A water-ballasted protection barrier array comprising:

a plurality of barrier segments, each of the plurality of barrier segments being hollow and adapted to be filled with a fluent material for ballast, each of the plurality of barrier segments providing energy absorption, deflection, and deformation from a vehicle impact, each of the plurality of barrier segments comprising:

a molded plastic container having outer walls defining an interior volume and having a first end and a second end, the molded plastic container having a plurality of feet extending therefrom to contact the ground, and a plurality of connecting lugs disposed on each of the first and second ends;

a plurality of first fence assemblies, each of the plurality of first fence assemblies including a pipe frame sized to fit in a superjacent relationship with one of the plurality of barrier segments to form a stacked first fence assembly-barrier segment combination, the pipe frame defining an interior space spanned by a chain link mesh, the pipe frame having a first end and a second end with a plurality of first connectors disposed on each of the first and second ends, the plurality of first connectors each having an opening therethrough;

a plurality of second fence assemblies, each of the plurality of second fence assemblies including a pipe frame sized to fit in a lateral interposed relationship with two spaced stacked first fence assembly-barrier segment combinations, each of the plurality of second fence assemblies defining an interior space spanned by a chain link mesh, the pipe frame having a first end and a second end with a plurality of second connectors disposed on each of the first and second ends, the plurality of second connectors each having an opening therethrough;

a gate assembly including a pair of horizontally spaced and opposing gate posts configured to accept a door assembly therebetween, the pair of gate posts sized to fit in a lateral interposed relationship with two stacked first fence assembly-barrier segment combinations, each of the gate posts comprising:

an upright body having a first end and a second end, a plate integrally secured to the second end of the upright body and extending therefrom, the plate fitting beneath one of the feet of the plurality of feet of one of the plurality of barrier segments of the two stacked first fence assembly-barrier segment combinations such that the plate is interposed in a stabilized relationship between the ground and one of the feet of the plurality of feet of one of the plurality of barrier segments, the plate being aligned with one of the first fence assemblies and second fence assemblies, a third connector extending from the upright body, the third connector having an opening therethrough, a gusset integrally located at the second end of the upright body and extending upward from the plate;

the connecting lugs, the first connectors, and the second connectors having a common vertical axial alignment such that a connecting rod is inserted therethrough to securably join one of the first fence assembly-barrier segment combinations and one of the second fence assemblies, the connecting rod further comprises a vertical pin having a head at an end, the vertical pin including at least one frangible break-point therein; and the connecting lugs, the first connectors, and the third connectors having a common vertical axial alignment such that a connecting rod is inserted therethrough to securably join one of the first fence assembly-barrier segment combinations and the gate assembly.

2. The water-ballasted protection barrier array as recited in claim 1, wherein the first connectors of each of the plurality of first fence assemblies further comprise vertically spaced connector boxes each having a channel therethrough for accepting the connecting rod.

3. The water-ballasted protection barrier array as recited in claim 1, wherein the first connectors of each of the plurality of first fence assemblies further comprise two vertically spaced connector boxes each having a channel therethrough for accepting the connecting rod on the first end and two vertically spaced connector boxes each having a channel therethrough for accepting the connecting rod on the second end.

4. The water-ballasted protection barrier array as recited in claim 1, wherein the second connectors of each of the plurality of second fence assemblies further comprise vertically spaced connector boxes each having a channel therethrough for accepting the connecting rod.

5. The water-ballasted protection barrier array as recited in claim 1, wherein the second connectors of each of the plurality of second fence assemblies further comprise three vertically spaced connector boxes each having a channel therethrough for accepting the connecting rod on the first end and three vertically spaced connector boxes each having a channel therethrough for accepting the connecting rod on the second end.

6. The water-ballasted protection barrier array as recited in claim 1, wherein the plate is substantially rectangular in shape.

7. The water-ballasted protection barrier array as recited in claim 1, wherein the third connector further comprises a tab having a keyhole therethrough for accepting the connecting rod.

8. The water-ballasted protection barrier array as recited in claim 1, wherein the connecting rod further comprises a vertical pin having a head at an end.

9. The water-ballasted protection barrier array as recited in claim 1, wherein each of the plurality of first fence assemblies, the plurality of second fence assemblies and the gate assembly further comprise a plurality of frangible break-points therein.

10. A water-ballasted protection barrier array comprising:

a plurality of barrier segments, each of the plurality of barrier segments being hollow and adapted to be filled with a fluent material for ballast, each of the plurality of barrier segments providing energy absorption, deflection, and deformation from a vehicle impact, each of the plurality of barrier segments comprising:

a molded plastic container having outer walls defining an interior volume and having a first end and a second end, the molded plastic container having a plurality of feet extending therefrom to contact the ground, and a plurality of connecting lugs disposed on each of the first and second ends;

a plurality of first fence assemblies, each of the plurality of first fence assemblies including a pipe frame sized to fit in a superjacent relationship with one of the plurality of barrier segments to form a stacked first fence assembly-barrier segment combination, the pipe frame defining an interior space spanned by a chain link mesh, the pipe frame having a first end and a second end with a plurality of first connectors disposed on each of the first and second ends, the plurality of first connectors each having an opening therethrough;

a gate assembly including a pair of horizontally spaced and opposing gate posts configured to accept a door assembly therebetween, the pair of gate posts sized to fit in a lateral interposed relationship with two stacked first fence assembly-barrier segment combinations, each of the gate posts comprising:

an upright body having a first end and a second end, a plate integrally secured to the second end of the upright body and extending therefrom, the plate fitting beneath one of the feet of the plurality of feet of one of the plurality of barrier segments of the two stacked first fence assembly-barrier segment combinations such that the plate is interposed in a stabilized relationship between the ground and one of the feet of the plurality of feet of one of the plurality of barrier segments, the plate being aligned with one of the first fence assemblies and second fence assemblies, a second connector extending from the upright body, the second connector having an opening therethrough, and a gusset integrally located at the second end of the upright body and extending upward from the plate; and the connecting lugs, the first connectors, and the second connectors having a common vertical axial alignment such that a connecting rod is inserted therethrough to securably join first fence assembly-barrier segment combinations and the gate assembly, the connecting rod further comprises a vertical pin having a head at an end, the vertical pin including at least one frangible break-point therein.

11. The water-ballasted protection barrier array as recited in claim 10, wherein the first connectors of each of the plurality of first fence assemblies further comprise vertically spaced connector boxes each having a channel therethrough for accepting the connecting rod.

12. The water-ballasted protection barrier array as recited in claim 10, wherein the second connector further comprises a tab having a keyhole therethrough for accepting the connecting rod.

13. The water-ballasted protection barrier array as recited in claim 10, wherein the connecting rod further comprises a vertical pin having a head at an end.

14. A water-ballasted protection barrier array comprising:

a plurality of barrier segments, each of the plurality of barrier segments being hollow and adapted to be filled with a fluent material for ballast, each of the plurality of barrier segments providing energy absorption, deflection, and deformation from a vehicle impact, each of the plurality of barrier segments comprising:

a molded plastic container having outer walls defining an interior volume and having a first end and a second end, the molded plastic container having a plurality of feet extending therefrom to contact the ground, and a plurality of connecting lugs disposed on each of the first and second ends;

a plurality of first fence assemblies, each of the plurality of first fence assemblies including a pipe frame sized to fit in a superjacent relationship with one of the plurality of barrier segments to form a stacked first fence assembly-barrier segment combination, the pipe frame defining an interior space spanned by a chain link mesh, the pipe frame having a first end and a second end with a plurality of first connectors disposed on each of the first and second ends, the plurality of first connectors each having an opening therethrough;

a plurality of second fence assemblies, each of the plurality of second fence assemblies including a pipe frame sized to fit in a lateral interposed relationship with two spaced stacked first fence assembly-barrier segment combinations, each of the plurality of second fence assemblies defining an interior space spanned by a chain link mesh, the pipe frame having a first end and a second end with a plurality of second connectors disposed on each of the first and second ends, the plurality of second connectors each having an opening therethrough;

a gate assembly including a pair of horizontally spaced and opposing gate posts configured to accept a door assembly therebetween, the pair of gate posts sized to fit in a lateral interposed relationship with two stacked first fence assembly-barrier segment combinations, each of the gate posts comprising:

an upright body having a first end and a second end, a plate integrally secured to the second end of the upright body and extending therefrom, the plate fitting beneath one of the feet of the plurality of feet of one of the plurality of barrier segments of the two stacked first fence assembly-barrier segment combinations such that the plate is interposed in a stabilized relationship between the ground and one of the feet of the plurality of feet of one of the plurality of barrier segments, the plate being aligned with one of the first fence assemblies and second fence assemblies, and a third connector extending from the upright body, the third connector having an opening therethrough;

the connecting lugs, the first connectors, and the second connectors having a common vertical axial alignment such that a connecting rod is inserted therethrough to securably join one of the first fence assembly-barrier segment combinations and one of the second fence assemblies; and the connecting lugs, the first connectors, and the third connectors having a common vertical axial alignment such that a connecting rod is inserted therethrough to securably join one of the first fence assembly-barrier segment combinations and the gate assembly, the connecting rod further comprises a vertical pin having a head at an end, the vertical pin including at least one frangible break-point therein.

* * * * *